United States Patent [19]

Tibbs

[11] 4,071,148

[45] Jan. 31, 1978

[54] AUTOMATIC PNEUMATIC CONNECTOR FOR AIR BRAKES AND THE LIKE

[76] Inventor: Lilburn E. Tibbs, 3511 E. Rialto, Fresno, Calif. 93726

[21] Appl. No.: 708,093

[22] Filed: July 23, 1976

[51] Int. Cl.[2] ..... B61G 5/06

[52] U.S. Cl. ..... 213/76; 213/1 R; 285/63

[58] Field of Search ..... 213/1.3, 76; 285/24, 285/27, 65, 70, 63

[56] References Cited

U.S. PATENT DOCUMENTS

| | | | |
|---|---|---|---|
| 814,924 | 3/1906 | Tomlinson | 213/104 |
| 1,094,612 | 4/1914 | Tomlinson | 213/76 |
| 1,737,271 | 11/1929 | Schmoll | 213/76 |
| 3,591,017 | 7/1971 | Cope | 213/76 |
| 3,802,578 | 4/1974 | Farnsworth | 213/1.3 |

*Primary Examiner*—Trygve M. Blix
*Assistant Examiner*—Edward M. Wacyra
*Attorney, Agent, or Firm*—Huebner & Worrel

[57] ABSTRACT

An automatic pneumatic connector for air brakes for mounting on couplers of railroad cars for relative elevational, longitudinal, and swivel motion with air-tight integrity being obtained by springs compresssing abutting gaskets and with guides to bring the gaskets into engagement as the railroad cars are coupled.

10 Claims, 14 Drawing Figures

AUTOMATIC PNEUMATIC CONNECTOR FOR AIR BRAKES AND THE LIKE

BACKGROUND OF THE INVENTION

1. Field of the Invention

The present invention relates to an automatic pneumatic connector, and more particularly to such a connector for the air brake systems of railroad cars.

2. Description of the Prior Art

Automatic coupling devices for interconnecting railroad cars themselves have existed for many years, but connection of the air brake systems of the railroad cars has still required that a person go between each pair of cars and manually couple the air brake systems.

The hazards to a person going between the cars are so great that for many years railroad cars have been required by law to have devices that couple them automatically as they approach each other, and such devices also allow uncoupling without going between the coupled railroad cars. However, the hazards to a person coupling the air brake systems have simply been accepted, even though acknowledged, because of the absence of any dependably succesful automatic pneumatic coupling.

In addition to the hazards involved in the manual coupling of the air brakes systems of railroad cars, considerable time is required for such coupling in "making up" a train with resulting delays in operation of trains and higher labor costs.

An additional problem with the existing railroad air brake coupling systems is that the provision in such systems for automatically uncoupling often allows uncoupling while a train is in motion resulting in an "emergency" application of the brakes with great risk of derailment and other resultant accidents.

While there are existing devices for coupling hoses automatically, automatic coupling by itself is not sufficient since such a device for railroad air brake systems must function independently of the direction the cars to be coupled are headed; that is, the devices must be identical at each end of a car. Furthermore, the automatic coupling must occur even though the coupling devices are not substantially aligned as they initially approach each other. Also, the coupling must be maintained in air-tight interconnection despite substantial relative motion of a pair of interconnected railroad cars due to curves, elevational deflections and changes in load. Finally, an automatic railroad air brake coupling system should provide for automatic uncoupling when coupled cars are separated.

SUMMARY OF THE INVENTION

Accordingly, it is an object of the present invention to provide an automatic pneumatic connector for interconnecting air brake systems of railroad cars.

Another object is to provide for railroad cars a pneumatic connector whose operation does not require a person to go between the cars.

Another object is to provide an automatic pneumatic connector for railroad cars in which substantially identical couplings may be employed at both ends of all cars.

Another object is to provide an automatic pneumatic connector for railroad cars which will uncouple automatically only when the interconnected cars are uncoupled and substantially separated.

Another object is to provide an automatic pneumatic connector for railroad air brake systems which is compatible with existing railroad car couplers and with existing methods of railroad operation.

Further objects are to provide an automatic pneumatic connector for the air brake systems of railroad cars which will interconnect such air brakes systems without manual assistance and resulting hazards despite substantial lack of alignment of the pneumatic couplings or the railroad car couplers and will remain air-tight once coupled despite misalignment from such causes as curves, elevational deflections, and load condition of the interconnected railroad cars.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
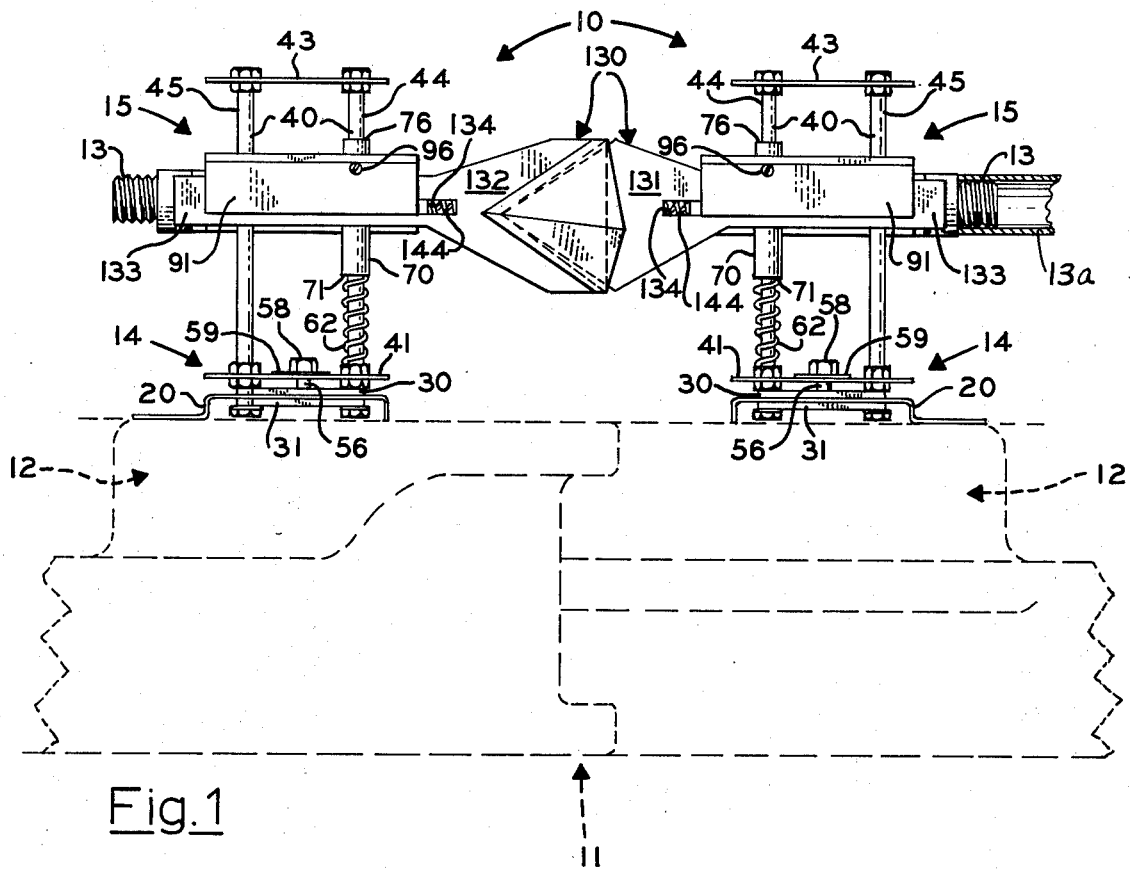
FIG. 1 is an elevation of two automatic pneumatic couplings for air brakes embodying the principles of the present invention showing the couplings mounted on railroad car couplers with the couplings mutually engaged.

Referring more particularly to the drawings, in FIG. 1 are shown a pair of substantially identical oppositely facing automatic pneumatic couplings 10 for air brakes embodying the principles of the present invention. The couplings 10 are shown in engagement and mounted on conventional mechanical couplings 11 for railroad cars. The railroad car couplings have a pair of releasably interconnected latch members 12 extending towards each other from their respective railroad cars, not shown, and adapted for interconnection during relative vertical and horizontally angular movement of the railroad cars. The pneumatic couplings are adapted by screw threads 13 for connection to a pneumatic brake system 13*a*, of a respective railroad car and have a mounting assembly, indicated generally by the numeral 14 and a carriage assembly, indicated generally by the numeral 15.

As herein used for purposes of description of the structure and operation of the preferred embodiment, the term "longitudinal" means substantially parallel to the direction along which the couplings are moved toward each other for coupling, the term "transverse" means substantially horizontally perpendicular to the longitudinal direction, the term "forward" means longitudinally toward the opposite coupling, and the term "rearward" means longitudinally away from the opposite coupling.

Figure 4:
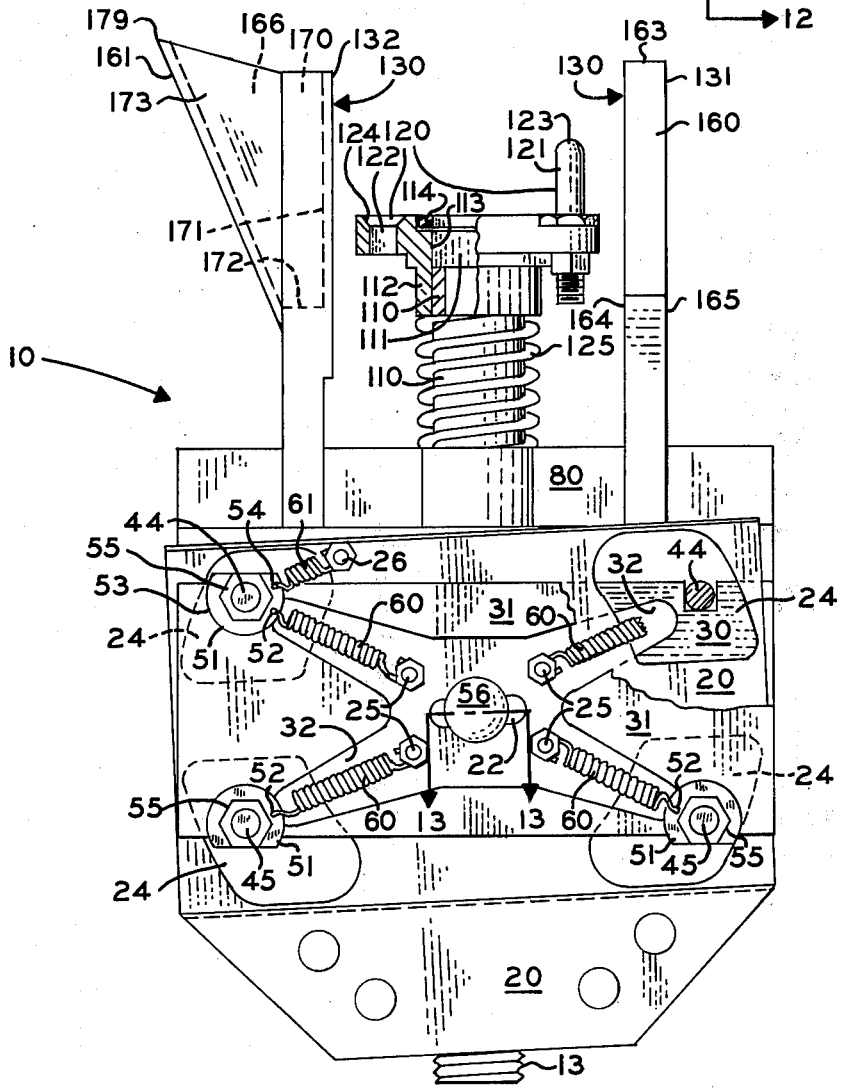
FIG. 4 is a bottom plan view of the coupling in a disengaged position with portions broken away to show a slot in the base plate and to show the construction of a head utilized therein.

The mounting assembly 14 of each automatic pneumatic coupling 10 has a base member on plate 20 mounted on the latch member 12 of its respective railroad car. The base plate has a substantially rectangular recess 21 in its lower surface. As best seen in FIG. 4, above the recess the base plate is pierced with a central transverse slot 22 forming opposite transverse surfaces 23, and is pierced with four segmentally shaped openings 24 spaced toward the corners of the rectangular recess. The base plate has four rectangularly spaced tension spring anchors 25 located toward the central transverse slot and has a single tension spring anchor 26 spaced from one of the segmentally shaped slots 24 in a substantially counterclockwise direction about the central slot 22 as seen from above the base plate.

Figure 12:
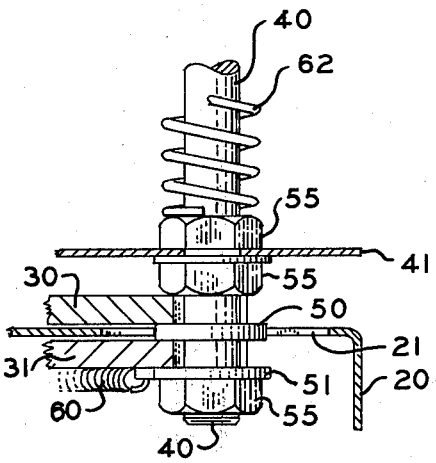
FIG. 12 is a fragmentary vertical section taken at line 12—12 of FIG. 3 showing the lower portion of a post and elements associated therewith.

As best seen in FIGS. 1, 4, and 12, a pair of horizontal rectangular bearing plates 30 and 31 are slidably fitted, respectively, to the upper and lower surfaces of the rectangular recess 21 in the base plate 20. The bearing plates have their central portions 32 removed to permit mounting of the four tension spring anchors 25 and other elements, not yet described, on the base plate 20.

In FIGS. 1 and 12, four cylindrical posts 40 are shown to extend vertically upwardly through, sequentially, the lower bearing plate 31, the four segmentally-shaped openings 24 toward the corners of the base plate, the upper bearing plate 30, a lower plate 41 having a central vertical bore 42, the carriage assembly 15, and a top plate 43. For descriptive purposes the four vertical posts 40 will be referred to as consisting of a forward pair 44 and a rearward pair 45.

Referring to FIG. 12, spacers 50 are mounted on the vertical posts 40 and are interposed between the upper bearing plate 30 and the lower bearing plate 31 spacing them for slidable fit, respectively, on the upper and lower surfaces of the base plate 20.

Figure 13:
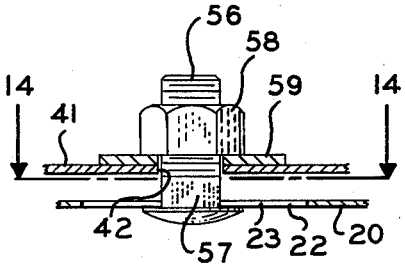
FIG. 13 is a fragmentary vertical section taken at line 13—13 of FIGS. 4 showing the central bolt.
Figure 14:
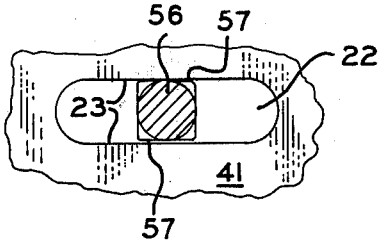
FIG. 14 is a fragmentary horizontal section taken at line 14—14 of FIG. 13 showing the central bolt fitted to the transverse slot in the base plate.

As shown in FIGS. 4 and 12, four washers 51 each having a radially offset hole 52 disposed toward the four tension spring anchors 25 are individually fitted to the posts 40 adjacent to the lower surface of the lower bearing plate 31. A washer 53, of the four washers 51, in a substantially counterclockwise direction from the single tension spring anchor 26, has a second radially offset hole 54 disposed toward said tension spring anchor. Nuts 55 fitted to the posts 40 secure the top plate 43, the lower plate 41, the upper bearing plate 30, and the lower bearing plate 31, in a rigid assembly. Referring to FIGS. 13 and 14, a vertical bolt 56 having opposite plane surfaces 57 fitted to the longitudinal surfaces 23 of the transverse central slot 22 in the base plate 20 is fitted vertically through the base plate and through the central bore 42 of the lower plate 41. The bolt 56 is retained by a nut 58 and washer 59.

Figure 3:
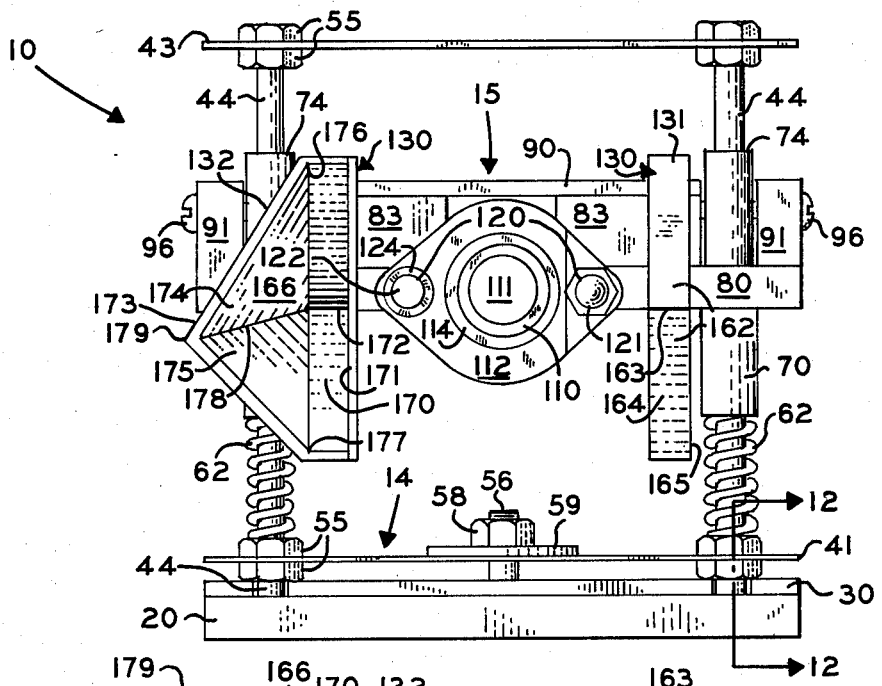
FIG. 3 is an elevation of a coupling of the present invention viewed from the opposite coupling.

In FIG. 4, four centralizing tension springs 60 are shown to interconnect the tension spring anchors 25 on the base plate and the holes 52 in the washers 51 mounted on the posts 40, and urge the mounting assembly 14 toward a central position on its base plate 20. A pivoting tension spring 61 interconnects the single tension spring anchor 26 with the second radially offset hole 54 in the washer 53. As shown in FIGS. 1 and 3, compression springs 62 are mounted on the forward pair 44 of the posts 40 between the lower plate 41 and the carriage assembly 15 and urge the carriage assembly upwardly toward an intermediate position on the posts 40.

Figure 11:
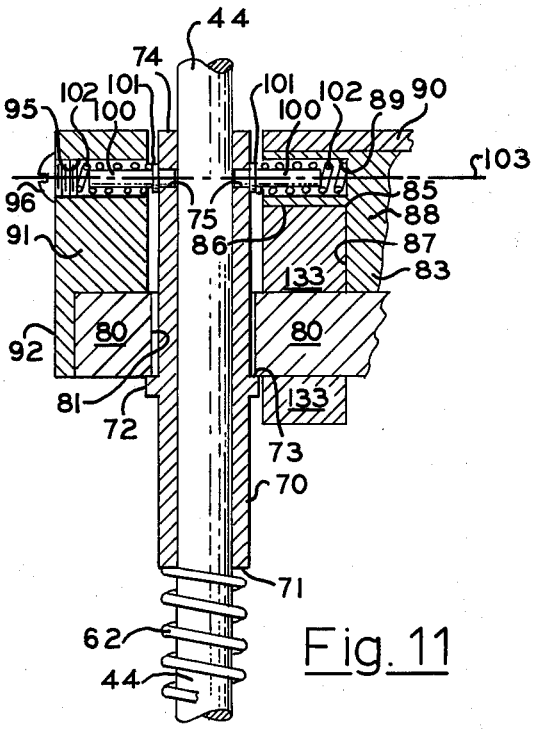
FIG. 11 is a fragmentary vertical section taken on line 11—11 of FIG. 6 showing the mounting of a sleeve on the carriage assembly with associated elements.

As evident in FIGS. 4 and 11, the carriage assembly 15 has exteriorly substantially cylindrical sleeves 70 slidably mounted on the forward pair 44 of the posts 40 for limited movement perpendicular to said posts. The lower ends 71 of the sleeves bear upon the springs 62 which urge the carriage assembly upwardly. The sleeves have intermediate collars 72 extending circumferentially therefrom with the collars having upper surfaces 73. The portions 74 of the sleeves above the intermediate collars 72 have toward their upward ends a pair 75 of opposite transversely aligned bores.

As best shown in FIGS. 3, 5, 6, and 11, the carriage assembly 15 has a horizontally substantially rectangular support plate 80 borne on the upper surfaces 73 of the collars 72 of the sleeves 70. The support plate has openings 81, best seen in FIG. 6, through which extend the rearward pair 45 of the posts 40 and the upper portions 74 of the sleeves 70. The support plate has a central longitudinal bore 82 illustrated in FIGS. 5 and 6. Four inner bearing blocks 83 are mounted on the upper surface of the support plate outwardly of the central longitudinal bore 82 having vertical surfaces 84 disposed toward the openings 81. Each inner bearing block has at its lower outward corner a longitudinal rectangular notch 85 forming an upwardly disposed horizontal surface 86 and an inwardly disposed vertical surface 87 on the inner bearing block. The forward pair 88 of the inner bearing blocks also have transverse bores 89, best shown in FIG. 11, substantially aligned with the bores 75 in the sleeves 70.

Figure 5:
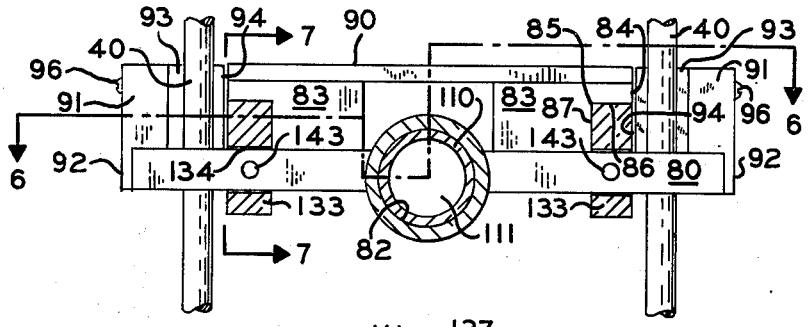
FIG. 5 is a transverse section taken on line 5—5 of FIG. 2 showing the mounting of the pneumatic conduit and the guides.
Figure 6:
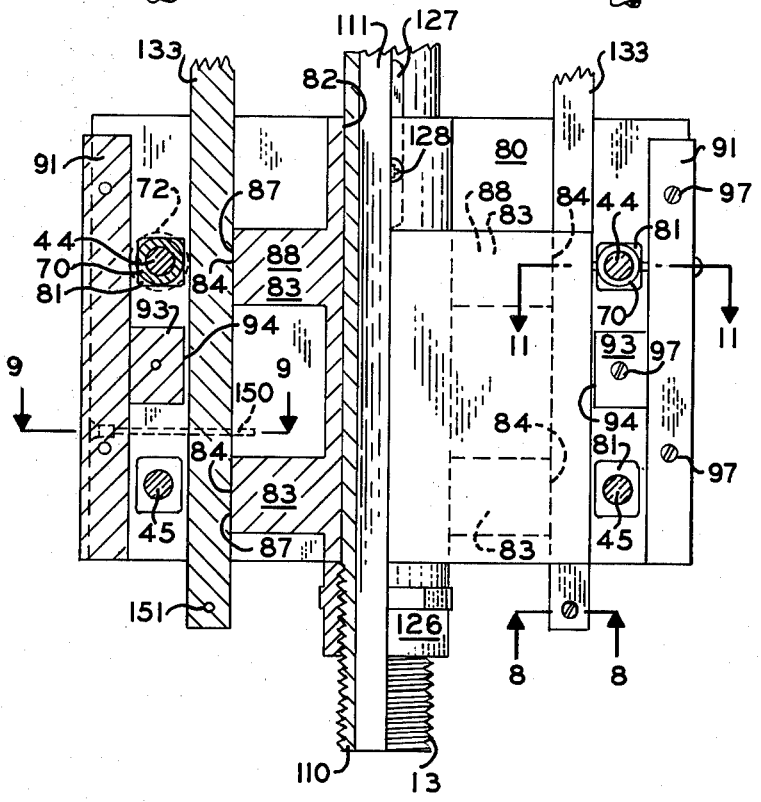
FIG. 6 is a horizontal section taken on line 6—6 of FIG. 5 further showing the mounting of the pneumatic conduit and the guides.

In FIGS. 5 and 6, the support plate 80 is shown also a plate 90 mounted on the upper surfaces of the inner bearing blocks 83. A pair of longitudinally elongated outer bearing blocks 91 are detachably mounted on the outwardly disposed edges of the upper surface of the support plate. Each outer bearing block has a flange 92 at its lower outwardly disposed corner downwardly fitted to the respective outward edge of the support plate. Each outer bearing block also has a block-shaped extension 93 disposed between the corresponding inner bearing blocks 83 and terminating centrally in a vertical surface 94 substantially in the plane of the outer vertical surfaces 84 of the inner bearing blocks 83. Each outer bearing block also has a transverse bore 95 aligned with the corresponding transverse bore 89 in an inner bearing block 83 and substantially aligned with the bores 75 in the sleeve 70 as illustrated in FIG. 11. The bores 95 in the outer bearing blocks are closed at their outward ends by plugs 96 screw threadably engaged in the outer bearing blocks. The outer bearing blocks are secured to the support plate by screw assemblies 97.

As best shown in FIG. 11, a substantially cylindrical pin 100 having a circumferential collar 101 toward one end is fitted to each bore of the pair 75 of opposite transverse aligned bores in each sleeve 70. A pair of such pins 100 are fitted to the pair 75 of aligned bores with the circumferential collars bearing oppositely transversely on the sleeve and with the ends of said pins opposite to the collars extending, respectively, into a bore 89 in an inner bearing block 83 and into the opposite bore 95 in the corresponding outer bearing block 91. Coil compression springs 102 are located in the bores 89 and 95 in the bearing blocks and are interiorly fitted to the ends of the pins 100 opposite to the sleeves. The pair of pins 100, the aligned bores 75 in each sleeve, and the opposite bores 89 and 95 in the, respectively, inner and outer bearing blocks define and substantially lie along an axis 103 about which the sleeve pivots. The springs 102 bear against the collars 101 urging each pair 100 of pins oppositely toward their respective sleeves 70 and urging the sleeves toward a transversely central position along their respective pivotal axes 103.

Figure 2:
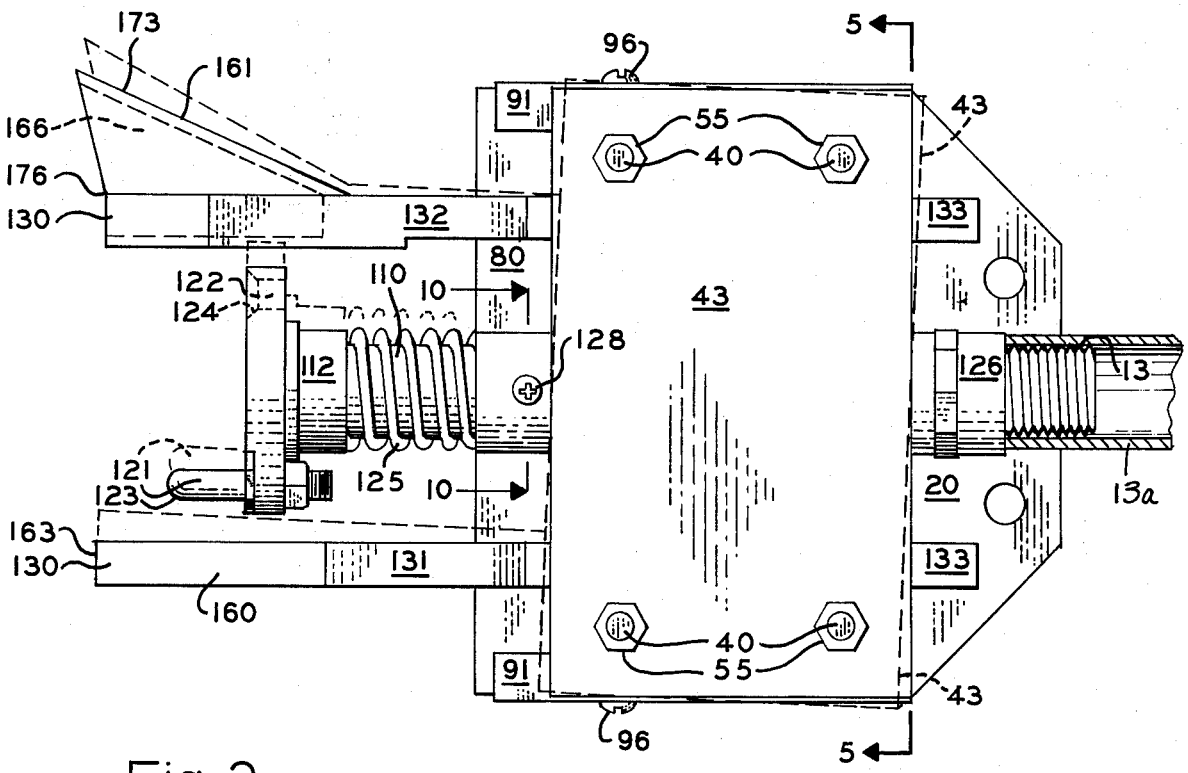
FIG. 2 is a top plan view at a somewhat enlarged scale of an individual coupling with dashed lines showing the relative position of certain of the elements with the coupling disengaged.

As best shown in FIGS. 2 and 6, a substantially cylindrical elongated rigid pneumatic conduit 110 is slidably fitted in the central longitudinal bore 82 of the support plate 80. This conduit bears at its rearward end the screw threads 13 for connection to the air brake system of its respective railroad car and has an opening 111, best shown in FIG. 3, in its forward end for communication with the opposite pneumatic coupling. The forward end of the conduit has a head 112, shown in FIGS. 3 and 4, with a passage 113 communicating with the conduit and the opening 101. A gasket 114 is in circumscribing relation to the passage 113 and the opening 111 and is adapted for longitudinally compressive engagement with the corresponding gasket of the opposite coupling assembly.

Figure 10:
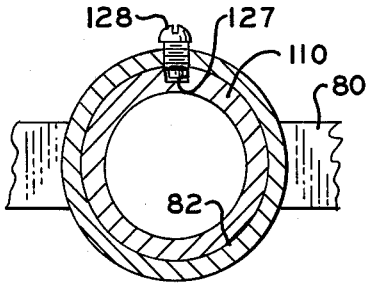
FIG. 10 is a fragmentary vertical section taken on line 10—10 of FIG. 2 showing provisions for preventing rotation of the pneumatic conduit.

Referring to FIGS. 3 and 4, the head 112 has final alignment members 120 consisting of a projection or cylindrical pin 121 and a socket or bore 122 mounted oppositely transversely of the gasket 114 with their axes substantially parallel to the axis of the longitudinal pneumatic conduit 110. The pin extends longitudinally beyond the gasket toward the opposite coupling 10 terminating with a hemispherical end 123. The bore 122 has a countersink 124 disposed toward the opposite coupling. A spring 125 urges the pneumatic conduit 110 longitudinally toward the opposite coupling. As best shown in FIG. 2, a nut 126 is mounted on the screw threads 13 toward the rearward end of the conduit and limits the longitudinal movement of the conduit to an extent greater than permitted by gasket engagement when the latch members 12 are latched. As best shown in FIGS. 2, 6, and 10, the conduit is prevented from rotation in the support plate 80 by a keyway 127 in the conduit which is engaged by a screw 128 extending radially into the central longitudinal bore 82 of the support plate.

Figure 7:
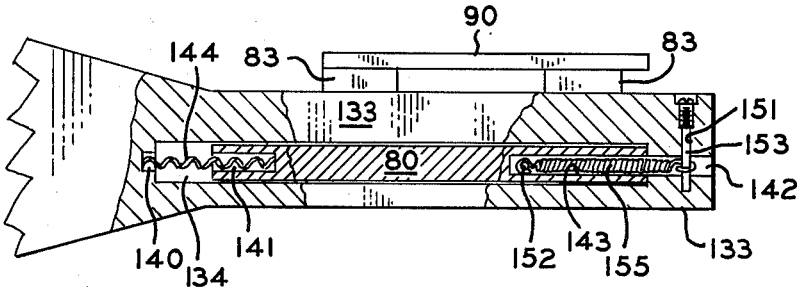
FIG. 7 is a vertical fragmentary section at a somewhat enlarged scale taken on line 7—7 of FIG. 5 with portions broken away further to show the mounting of a guide.

As evident in FIGS. 3 and 4, the carriage assembly 15 has a pair of preliminary alignment members or guides 130 consisting of a male guide 131 and a female guide 132. These guides are slidably mounted for longitudinal movement on the support plate 80 and are mounted transversely oppositely outwardly of the pneumatic conduit 110. As best seen in FIGS. 5, 6, and 7, the rearward portions 133 of both the male and the female guides are substantially identical and are of vertical plate-like form each having a transverse slot 134 of greater length than the support plate 80. Each guide is mounted with the support plate extending through the slot 134 and with the upper and lower surfaces of the support plate fitted, respectively, to the upper and lower surfaces of the slot. Also, each guide is mounted on the support plate with the centrally disposed surface of the rearward portion 133 of the guide fitted to the vertical surfaces 87 of its respective longitudinal pair of inner bearing blocks, and with the outwardly disposed surface of the rearward portion 133 of the guide fitted to the vertical surface 94 of its respective outer bearing block 91.

As best shown in FIG. 7, the forward surface of each slot 134 has a longitudinal bore 140 substantially aligned with a longitudinal bore 141 in the forward edge of the support plate 80, and the rearward surface of each slot 134 has a longitudinal bore 142 substantially aligned with a longitudinal bore 143 in the rearward surface of the slot. A compression spring 144 within each corresponding pair of forward bores 140 and 141 urges the respective guide toward the opposite coupling.

Figure 8:
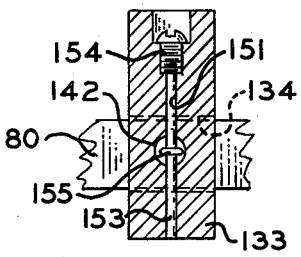
FIG. 8 is a fragmentary vertical section at an enlarged scale taken on line 8—8 of FIG. 6 showing a spring anchor in a guide.
Figure 9:
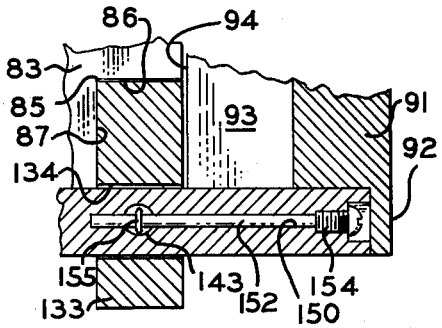
FIG. 9 is a vertical fragmentary section taken on line 9—9 of FIG. 6 showing a spring anchor in the carriage assembly.

Referring to FIGS. 7, 8, and 9, each rearward bore 142 in the support plate 80 has toward its forward end an intersecting transverse bore 150, and the rearward bore 143 in each guide 130 has toward its rearward end an intersecting vertical bore 151. Tension spring anchor pins 152 and 153 are fitted, respectively, to the transverse bore 150 in the support plate and to the vertical bore 151 in the guide, and are secured by screw threads 154. A tension spring 155 interconnects the spring anchor pins 152 and 153 and, in cooperation with the respective compression spring 144, urges its respective guide toward the opposite coupling.

As best shown in FIGS. 1, 3, and 4, the forward position 160 of the male preliminary alignment guide 131 and the forward portion 161 of the female preliminary alignment guide 132 extend longitudinally toward the opposite 10, are adapted to mate with the respectively oppositely corresponding guide of the opposite coupling, and are adapted to engage as the opposite coupling move toward each other before the cylindrical pin 121 and bore 122 on the head 112 of conduit 110 engage. The forward portion 160 of the male guide has upper and lower plane surfaces 162 forwardly converging to an apex 163 substantially in the plane of the support plate 80, and has said upper and lower plane surfaces bound transversely by substantially vertical plane surfaces 164 and 165, which are, resectively, centrally and outwardly disposed. The forward portion 161 of the female guide has a funnel-shaped pocket 166 opening toward the opposite coupling.

The pocket 166 of the female preliminary alignment guide 132 has a centrally disposed portion 170 of a form corresponding to the centrally disposed vertical surface 164 and to the upper and lower converging plane surfaces 162 of a male preliminary alignment guide 131. The centrally disposed portion 170 of the pocket has a centrally disposed wall 171 and also has an apex 172 corresponding to the apex 163 of a male preliminary engagement guide. The pocket 166 has an outwardly disposed portion 173 formed by intersecting inclined planes, consisting of an upward inclined plane 174 and a lower inclined plane 175, adapted to direct an opposite male guide 131 into engagement with the centrally disposed portion 170 of said pocket. The said inclined planes or walls 174 and 175 are joined at their, respective, upper and lower edges 176 and 177 to the centrally disposed portion 170 of the pocket 166, and have their line 178 of intersection diverging outwardly from the apex 172 of the inward portion of the pocket 166. The forward end 179 of said line of intersection 178 is disposed below the apex 172 of the centrally disposed portion of the pocket and extends longitudinally forwardly beyond said centrally disposed portion. As will be apparent, the walls 174 and 175 serve as a funnel to direct the male guides 131 into the female guides 132.

OPERATION

The operation of the described embodiment of the present invention is believed to be clearly apparent and is briefly summarized at this point. The automatic pneumatic coupling 10 is mounted on and above the latch member 12 of a railroad car, substantially as shown in FIG. 1, and is connected to the air brake system of the car by the screw threads 13 on the rigid longitudinal conduit 110. The pneumatic couplings are mounted on adjacent ends of adjacent railroad cars so that, as shown in FIG. 3, the male preliminary alignment guide 131 and the cylindrical pin 121 of the final alignment members 120 are to the right as seen from an opposite coupling. It will be obvious that if the pneumatic coupling is so mounted on all railroad cars, the pneumatic coupling will be disposed for proper engagement. It will also be obvious that the present invention would function as well with either the preliminary guides or final alignment members or both having their mating elements reversed transversely so long as all pneumatic couplings were installed in a consistent manner.

The automatic pneumatic coupling 10 for interconnecting air brake systems of railroad cars must be capable of coupling despite substantial misalignment of the pneumatic couplings due to the railroad car latch members 12 and the cars themselves having substantially differing relative positions both during coupling and when the cars are in motion. These differing relative positions are due to such causes as necessary tolerances and loose fits of the railroad car couplings, wear of these couplings, misalignment of the sections of railroad track under adjacent cars, and particularly due to differing loads of adjacent cars and curves in the track. To secure air-tight coupling despite misalignment, the present invention permits relative movement between the gasket 114, the element making the actual pneumatic coupling, and the base plate 20 attached to the coupler of a railroad car. Rotational relative movement about and translational relative movement along all three axes is permitted.

Relatively limited rotational movement about a longitudinal axis is permitted by the elements shown in FIG. 11. Since the sleeves 70 are smaller than the opening 81 in the support plate and since the support plate only bears on the upper surfaces 73 of the collars 72 of the sleeves, the support plate is permitted to tilt on the surfaces 73 relative to the sleeves and, of course, relative to the posts 40 on which the sleeves are mounted. This method of mounting the sleeves on the support plate also allows limited rotational movement of the support plate relative to the posts about the transverse pivotal axis 103. The relatively greater amount of rotational movement required about a vertical axis due to curves in the railroad track is provided by the swivel mounting of the lower plate 41, with its connected posts 40 and carriage assembly 15, to the base plate 20 by the vertical bolt 56. This same bolt 56, by the slidable mounting of its opposite plane surfaces 57 on the opposite transverse surfaces 23 formed by the central transverse slot 22 in the base plate 20, provides a relatively large amount of translational movement along a transverse axis. The four segmental openings 24 in the base plate 20 through which the vertical posts 40 extend allow a relatively large amount of movement of the base plate relative to the lower plate about the vertical bolt 56 without the posts striking the base plate. A relatively large amount of translational movement along a vertical axis is required for engagement of the pneumatic couplings 10 despite differing loading conditions of adjacent cars, and is provided by the slidable mounting of the sleeves 70 on the vertical posts 40. Finally, translational movement along a longitudinal axis is provided by the slidable mounting of the rigid pneumatic conduit 110 on the support plate 80.

When a pneumatic coupling 10 is completely disengaged from an opposite coupling 10, as shown in FIGS. 2 and 3, the coupling is urged by springs into a position deemed most advantageous for initial engagement with a misaligned opposite pneumatic coupling as the railroad cars on which the couplings are mounted move toward each other. The springs 62 mounted on the forward pair of posts 44 urge the carriage assembly 15 into substantially the central point of the vertical movement of said assembly on said posts permitting initial engagement of the preliminary engagement members or guides 130 despite relative vertical movement of the pneumatic couplings. Similarly, the springs 102 urge the sleeves 70 into a central position between opposite inner bearing blocks 83 and outer bearing blocks 91 to position the support plate 80 substantially horizontally when the pneumatic coupling is disengaged. Also, the four centralizing tension springs 60, as shown in FIG. 4, position the lower plate 41 substantially centrally transversely on the base plate 20. The four centralizing tension springs also urge the lower plate into a non-rotated position on the base plate; however, in the disengaged position, the pivoting tension spring 61 rotates the lower plate slightly clockwise as viewed from above. This rotation is indicated by the dotted lines in FIG. 2 and by the relatively slightly rotated position of the base plate to the balance of the pneumatic coupling in FIG. 4. This slightly rotated position insures that the apex 163 of a male preliminary engagement member 131 is initially directed into the pocket 166 of the opposite female member 132 rather than toward the centrally disposed wall 171 of said pocket.

Also, when a coupling is completely disengaged from an opposite coupling, the tension springs 155 and the compression springs 144 position the preliminary alignment members 130 in their most forward position for engagement with the oppositely corresponding members of an approaching coupling. Similarly, the spring 125 positions the pneumatic conduit 110 with its attached head 112, final alignment members 120, and gasket 114 in their most forward position when the coupling is completely disengaged.

As two opposite pneumatic couplings approach each other, the apices 163 of the male preliminary alignment guides 131 enter the pockets 166 of the opposite female preliminary alignment guides. Since the latch members 12 tend to sag at the end toward an opposite latch member as wear occurs, the pneumatic couplings also tend to incline downwardly toward the opposite coupling. To assist the apex of the male guide in engaging the pocket of the female guide when this condition has developed, the forward end 179 of the line of intersection 178 of the inclined planes 173 and 174 has a downward inclination toward the opposite coupling. As the couplings continue to move toward each other the apices 163 of the male guides 131 engage the inclined plane surfaces 174 and 175 of the female guides. On continued motion of the couplings toward each other, the inclined planes or walls 174 and 175 of the female guides in cooperation with the apex 163 and uper and lower plane surfaces 162 of the male guides, position the couplings so that the final alignment members 120 on the head 112 of the pneumatic conduit 110 are brought into engagement. As the pneumatic couplings continue to move toward each other, the hemispherical ends 123 of the cylindrical pins and the countersinks 124 of the bores 122 in the heads 112 of the pneumatic conduits 110 complete the alignment of the couplings so that the pneumatic conduits and the gaskets 114 approach each other on substantially the same longitudinal axis as determined by the parallel mounting of the pins 121 and bores 122 with the conduit. As the pneumatic couplings further approach each other, the gaskets 114 are brought into engagement. The pneumatic couplings are mounted relatively longitudinally on their respective railroad car couplers so that on final latching of the railroad car couplings 11 the gaskets are held in air-tight compressive engagement by the springs 125 which urge the rigid pneumatic conduits toward each other.

The preliminary alignment guides 130 are, of course, positioned relatively forwardly of the final alignment members 120 so that the male 131 and female 132 preliminary alignment guides have completed their preliminary alignment of the couplings before the final alignment members 120 engage. The preliminary alignment guides are therefore, fully engaged before the motion of the opposite couplings toward each other is complete, and any further motion of the couplings will move the preliminary alignment guides rearwardly on their slidable mountings on the support plate 80. Similarly, the gaskets 114 engage before the motion of the pneumatic couplings toward each other is complete, and the remaining movement of the couplings toward each other slides the rigid pneumatic conduits 110 rearwardly in the bores 82 in the support plates. This final rearward motion is, of course, necessary in the case of the conduits so that the gaskets will be held in compressive engagement by the springs 125 during relative longitudinal motion of the railroad car latch members 12.

Once the latch members 12 for the railroad cars are fully connected with their respective pneumatic couplings engaged, the force of the springs 125 holding the gaskets 114 in compressive engagement aided by any compressive contact between the forward surfaces of the heads 112 and the mating cylindrical pins 121 and bores 122, substantially prevent any relative vertical or transverse motion of the heads 112, and hold the opposite pneumatic conduit 110 in a substantially rigid and air-tight assembly. This assembly is maintained, despite relative movement of the railroad latch members by the floating and swivel action provided by the couplings.

If momentary and extreme relative movement occurs between opposite railroad car latch members 12 sufficient to bring the gaskets 114 out of engagement, the various elements of the pneumatic couplings cooperate in the same manner as on initial coupling immediately to maintain or restore air-tight engagement of the couplings.

When, however, the railroad car latch members 12 are released and the cars are separated, the pneumatic couplings of the present invention automatically assume their disengaged positions in preparation for again coupling automatically with an opposite coupling.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. An automatic connector for air lines and the like having a pair of substantially identical oppositely facing pneumatic couplings each comprising a carriage assembly; a substantially cylindrical horizontal pneumatic conduit adapted to communicate with a pneumatic brake system slidably mounted on the carriage assembly for axial movement toward and from the opposite coupling having an opening directed toward the opposite coupling having an opening directed toward the opposite coupling, said conduit having a gasket mounted on the end of the conduit disposed toward the opposite coupling in circumscribing relation to the opening in the conduit, said cylindrical conduit having radially outwardly of the gasket a cylindrical pin and opposite cylindrical bore with respective axes substantially parallel to the conduit with the pin extending beyond the gasket toward the opposite coupling and with the pin and bore being adapted to mate with, respectively, the bore and pin of the opposite coupling; resilient means urging the conduit toward the opposite coupling and urging the gasket into compressive engagement with the gasket of the opposite coupling; a male preliminary alignment guide; a female preliminary alignment guide, said male and female preliminary alignment guides being slidably mounted on the carriage assembly projecting in the direction of the opposite coupling and oppositely disposed outwardly radially from the conduit with the male guide having an apex disposed toward the opposite coupling and with the female guide having a pocket opening toward the opposite coupling with the centrally disposed portion of the pocket adjacenet to the conduit being adapted to mate with the male guide of the opposite coupling and with the opposite portion of the pocket outwardly from the conduit having outwardly inclined planes adapted to direct the male guide of the opposite coupling into mating engagement with said inward portion of the pocket; resilient means urging the male and female preliminary alignment guides toward the opposite coupling; a mounting assembly having a post on which the carriage assembly is slidably mounted for vertical movement and having resilient means urging the carriage assembly toward an intermediate position on said post; a base plate on which the mounting assembly is slidably mounted for horizontal movement substantially perpendicularly to the axis of the conduit and pivotally mounted for movement about a substantially vertical axis; and resilient means urging each mounting assembly toward a predetermined rest position on its respective base plate.

2. The automatic pneumatic connector of claim 1 having resilient means urging the mounting assemblies pivotally on the base plates toward a position wherein the points of the male preliminary alignment guides are directed toward the outward, inclined planes of the female preliminary alignment guides.

3. The automatic pneumatic connector of claim 1 wherein the carriage assembly of each coupling has a sleeve slidably mounted on the post and mounted on the carriage assembly with limited sliding movement perpendicular to the post and with limited pivotal motion about an axis radial to the posts and at right angles to the axis of the conduit, said carriage assembly also having resilient means urging the sleeve toward a central position along the pivotal axis.

4. In an automatic pneumatic connector for air lines and the like having a pair of substantially identical oppositely facing pneumatic couplings each comprising:

A. an elongated pneumatic conduit having an end adapted for connection to an air line and an opposite end disposed toward the opposite coupling in substantial axial alignment therewith;

B. means mounting the conduit for limited rotational, longitudinal and transverse displacement from a predetermined rest position;

C. resilient means urging the conduit into said rest position;

D. a male guide rigid with the conduit and disposed in substantially parallel spaced relation thereto having an end extended toward the opposite coupling providing endwardly convergent upper and lower surfaces;

E. a female guide rigid with the conduit and disposed in substantially parallel spaced relation to the conduit on the opposite side of the conduit from the male guide, the male and female guides being in substantially equally spaced relation to the conduit and the female guide having a pocket therein disposed toward the opposite coupling having inwardly convergent upper and lower surfaces and side walls opposite to the conduit individually continuous with the upper and lower surfaces of the pocket and obliquely outwardly extended toward the opposite coupling; and F. means mounting the couplings for movement toward each other with the male guides juxtaposed to respective female guides to bring the male guides into engagement with the female guides to align the conduits and in which the resilient means urges the conduits in a rotational direction displaced from alignment in the direction of the male guides from the conduit whereby upon such movement toward each other the male guides initially engage the side walls of the pockets of their respective female guides and continued movement toward each other causes the side walls to guide the male guides into nested engagement in their respective female guides.

5. The apparatus of claim 4 in which the convergent surfaces of the male guide and of the female guide are disposed in respective angularly related planes and the angularity between such surfaces on the male guide and such surfaces on the female guide are substantially the same.

6. The apparatus of claim 4 in which the upper surface of the male guide and the lower surface of the female guide are disposed in substantially parallel planes and the lower surface of the male guide and the upper surface of the female guide are disposed in substantially parallel planes.

7. The apparatus of claim 4 in which the side walls are substantially planar and intersect along a line which inclines inwardly of the pocket.

8. In an automatic pneumatic connector for air lines and the like, a pair of substantially identical oppositely facing couplings each comprising:

A. a carriage;

B. an elongated pneumatic conduit having an end adapted for connection to an air line and an opposite end disposed toward the opposite coupling, the conduit being mounted on the carriage for axial movement toward and from the opposite coupling and in approximate alignment therewith;

C. a gasket mounted on said opposite end of the conduit in circumscribing relation thereto;

D. resilient means urging the conduit in the direction of the opposite conduit;

E. means mounting the carriage for limited elevational movement, rotational movement about a substantially vertical axis and lateral movement transversely of the conduit;

F. a male guide mounted on the carriage in substantially parallel spaced relation to the conduit having a wedge-shaped end providing endwardly convergent upper and lower surfaces disposed toward the opposite coupling;

G. a female guide mounted on the carriage in substantially parallel relation to the conduit and spaced therefrom a distance substantially equal to the spacing of the male guide therefrom, the female guide having a pocket disposed toward the opposite coupling providing inwardly convergent upper and lower surfaces substantially complementary to the upper and lower surfaces of the male guide, the pocket having side walls opposite to the conduit continuous with said upper and lower surfaces respectively of the female guide obliquely outwardly extended toward the opposite coupling to form a funnel; and H. resilient means urging the carriage rotationally to a rest position displaced from precise alignment of the conduits in the direction of the male guide from the conduit.

9. The apparatus of claim 8 wherein the male and female guides serve as preliminary alignment members, adapted to engage the respectively opposite members of the opposite coupling and having final alignment members mounted on the conduit and adapted to be guided into engagement by the preliminary alignment members and further adapted to bring the conduits into alignment and communication on continued movement of the couplings toward each other.

10. The apparatus of claim 8 in which the mounting means are the couplers of adjacent railroad cars which are movable toward and from each other by relative movement of the railway cars and in which as the couplings are moved toward each other the male guides initially engage the funnels of their respective female guides for guided direction into said female guides with the conduits aligned in pneumatic communication.

* * * * *

UNITED STATES PATENT AND TRADEMARK OFFICE

CERTIFICATE OF CORRECTION

PATENT NO. : 4,071,148
DATED : January 31, 1978
INVENTOR(S) : Lilburn E. Tibbs

It is certified that error appears in the above-identified patent and that said Letters Patent are hereby corrected as shown below:

Column 2, line 5, delete "brakes" and insert ---brake---.

Column 3, line 27, after "member" delete "on" and insert ---or---.

Column 4, line 54, after "also" insert ---to have---.

Column 6, line 43, after "opposite" insert ---coupling---.

Line 46, make "coupling" plural.

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*